US009358563B2

(12) United States Patent
Kennemer et al.

(10) Patent No.: US 9,358,563 B2
(45) Date of Patent: Jun. 7, 2016

(54) BACKPACK SPRAYER

(71) Applicant: Tractor Supply Company, Brentwood, TN (US)

(72) Inventors: Brian Kennemer, Brentwood, TN (US); Luke W. Michas, Hendersonville, TN (US)

(73) Assignee: Tractor Supply Company, Brentwood, TN (US)

( * ) Notice: Subject to any disclaimer, the term of this patent is extended or adjusted under 35 U.S.C. 154(b) by 147 days.

(21) Appl. No.: 14/186,724

(22) Filed: Feb. 21, 2014

(65) Prior Publication Data

US 2015/0238987 A1 Aug. 27, 2015

(51) Int. Cl.
*A62C 15/00* (2006.01)
*B05B 9/08* (2006.01)

(52) U.S. Cl.
CPC ..... *B05B 9/085* (2013.01); *B05B 9/0888* (2013.01)

(58) Field of Classification Search
USPC ..... 239/152
See application file for complete search history.

(56) References Cited

U.S. PATENT DOCUMENTS 4,651,903 A * 3/1987 Pagliai ..... A01M 7/0046 222/175
4,768,714 A 9/1988 Luchsinger
5,335,853 A * 8/1994 Wirz ..... B05B 9/0877 222/175
5,636,791 A * 6/1997 Leer ..... B05B 9/0877 239/142
5,752,661 A * 5/1998 Lewis ..... B05B 9/0861 222/175
6,053,339 A 4/2000 Bellis, Jr.
6,412,707 B1 7/2002 Wirz
7,007,826 B2 * 3/2006 Shapanus ..... B05B 9/0861 222/175
7,175,104 B2 2/2007 Allen, IV
D547,416 S 7/2007 Hillhouse
D570,447 S 6/2008 Hillhouse
D590,043 S 4/2009 Campbell
D591,387 S 4/2009 Campbell
D594,087 S 6/2009 Campbell
D609,773 S 2/2010 Abernethy et al.
D618,300 S 6/2010 Hudson et al.
7,854,396 B2 * 12/2010 Wu ..... B05B 9/0877 239/152
D633,984 S 3/2011 Plantz
D672,848 S 12/2012 Wirz Luchsinger
D685,057 S 6/2013 Wirz Luchsinger
8,622,323 B2 * 1/2014 Klein ..... B05B 15/02 239/302
2006/0261181 A1 11/2006 Wirz
2010/0001100 A1 1/2010 Fontaine

FOREIGN PATENT DOCUMENTS

WO WO 2012045402 A1 * 4/2012 ..... A01M 7/0046

* cited by examiner

*Primary Examiner* — Len Tran
*Assistant Examiner* — Adam J Rogers
(74) *Attorney, Agent, or Firm* — Lucian Wayne Beavers; Garrett M. Hausman; Patterson Intellectual Property Law, PC

(57) ABSTRACT

A back pack sprayer apparatus for spraying liquids. The apparatus includes an integrally molded structure having an upper tank portion and a lower frame portion. A support stand can be connected to the molded structure, the support stand defining a supporting plane when the apparatus is in an upright position on the ground. The molded structure can have a front side defining a compound curve having an upper concave curve configured to receive an operator's back, and a lower convex curve terminating in a lowermost distal end forming a rearward angle of at least about 20 degrees with an axis normal to the supporting plane. The apparatus can include a pump, a hose, and a sprayer. A cover can be attached to the lower frame portion concealing the pump. The apparatus can include peripheral flanges and a lower drip rail which can help prevent liquid from contacting an operator.

26 Claims, 9 Drawing Sheets

BACKPACK SPRAYER

BACKGROUND OF THE INVENTION

1. Field of Invention

The present invention relates generally to portable backpack sprayers that can be worn on an operator's back and be used for spraying chemicals or other liquids.

2. Description of the Prior Art

Backpack sprayers are used for spraying chemicals or other liquids over a target area. One common use for backpack sprayers is to distribute pesticides over a lawn or garden. Often times the chemicals being distributed from the backpack sprayer are toxic or dangerous if they come into contact with an operator's body.

Conventional embodiments of backpack sprayers include a generally round tank. The tanks on conventional embodiments are awkward and can be uncomfortable to support on an operator's back. Additionally, conventional tanks for backpack sprayers can leak. The leaking chemicals can run down the tank and make contact with the operator's neck or back, potentially harming the operator.

What is needed, then, are improvements in backpack sprayers that make them easier to carry and reduce the likelihood of leakage contacting an operator.

BRIEF SUMMARY OF THE INVENTION

The present disclosure pertains to an improved backpack sprayer apparatus for spraying chemicals or other liquids. The apparatus can be carried on an operator's back or shoulders.

A first embodiment of a back pack sprayer apparatus includes an integrally molded structure having an upper tank portion and a lower frame portion. A support stand can be connected to the lower frame portion, the support stand defining a supporting plane of the apparatus for supporting the apparatus in an upright position from a ground surface when the apparatus is not being worn by an operator. The molded structure can have a front side defining a compound curve in side profile. The compound curve can include an upper concave curve configured to be received against the operator's back, and a lower convex curve terminating in a lowermost distal end. The lowermost distal end can form a rearward angle of at least about 20 degrees relative to an axis normal to the supporting plane.

A second embodiment of a back pack sprayer apparatus includes an integrally molded structure including an upper tank portion and a lower frame portion. The molded structure can have a front side defining a compound curve in side profile. The compound curve can include an upper concave curve configured to be received against an operator's back, and a lower convex curve terminating in a lowermost distal end. The lower frame portion can have a frame opening therethrough from the front side to a rear side of the molded structure. A pump can be located in the frame opening and communicated with the tank portion. A removable cover can be attached to the rear side of the molded structure and closes the frame opening to conceal the pump.

A third embodiment of a back pack sprayer apparatus includes an integrally molded structure including an upper tank portion and a lower frame portion. The molded structure can have a front side defining a compound curve in side profile, the compound curve including an upper concave curve and a lower convex curve. The molded structure can further include rearward facing peripheral side flanges extending laterally outward along the left and right sides of the molded structure. The peripheral side flanges can conform in side profile to the compound curve of the front side. The lower frame portion can include a lower frame end having a rearwardly curved rearward facing surface defining a lower drip rail across a width of the lower frame portion. The lower drip rail can be generally coplanar with the peripheral side flanges and configured to direct liquid spillage on the molded structure away from the operator's body.

For any of the embodiments mentioned above, the backpack sprayer apparatus can include a pump communicated with the tank portion of the integrally molded structure. A hose can be connected to the pump, and a sprayer can be connected to the hose. A back strap assembly can also be connected to the integrally molded structure.

One objective of the present disclosure is to provide a back pack sprayer configured to direct liquid spillage from the sprayer away from an operator's body.

Another objective of the present disclosure is to provide a back pack sprayer that is comfortable for an operator to wear on his back or shoulders.

DETAILED DESCRIPTION

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom, front, rear and other orientation terms are described with respect to this upright position during operation or a natural resting position unless otherwise specified. The term "when" is used to specify orientation for relative positions of components, not as a temporal limitation of the claims or apparatus described and claimed herein unless otherwise specified. The term "lateral" denotes a side to side direction when facing the "front" or "rear" of an object.

The present disclosure relates to an improved back pack sprayer apparatus. The back pack sprayer can be carried across the shoulders or back of an operator. The back pack sprayer can be used to spray chemicals on a targeted area. The chemicals being sprayed can often times be toxic or dangerous if they contact the operator's body. The back pack sprayer has improved safety aspects which help to prevent chemicals that may leak from the back pack sprayer from coming into contact with the operator's body. The back pack sprayer can also be configured such that it is easy and comfortable for an operator to carry on the back or shoulders.

Figure 1:
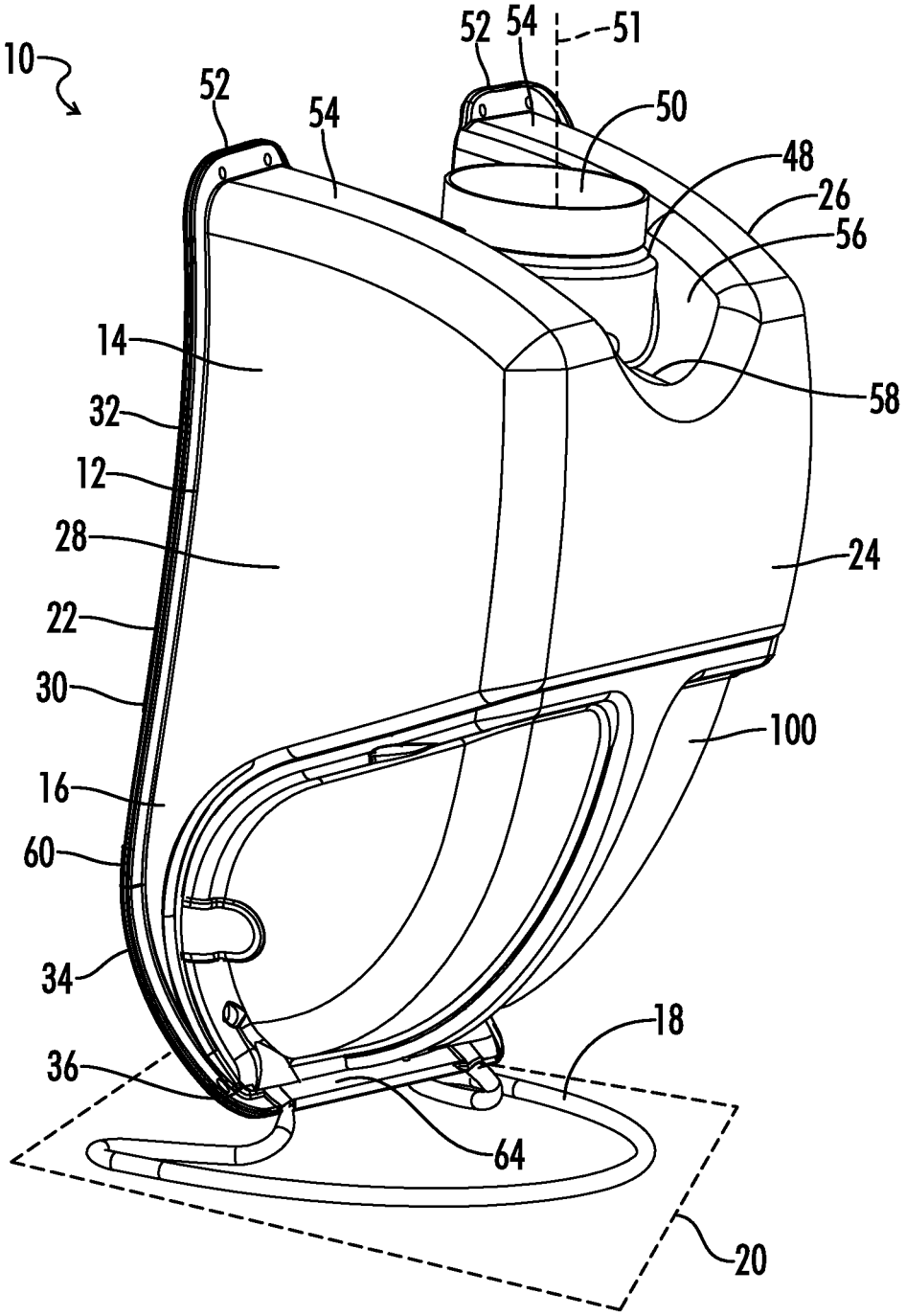
FIG. 1 is a rear perspective view of an embodiment of a back pack sprayer apparatus of the present invention.

A first embodiment of a back pack sprayer apparatus 10 is shown in FIG. 1. The back pack sprayer 10 can include an integrally molded structure 12 having an upper tank portion 14 and a lower frame portion 16. The upper tank portion 14 can be configured to hold liquids to be sprayed. The integrally molded structure 12 can have a front side 22, a rear side 24, a right side 26, and a left side 28. A support stand 18 can be connected to the lower frame portion 16. The support stand 18 can define a supporting plane 20 of the back pack sprayer 10 for supporting the back pack sprayer 10 in a generally upright position from a ground surface when the back pack sprayer 10 is not being worn by an operator. When the back pack sprayer 10 rests on a ground that is substantially level, the supporting plane 20 can have a generally horizontal orientation.

Figure 2:
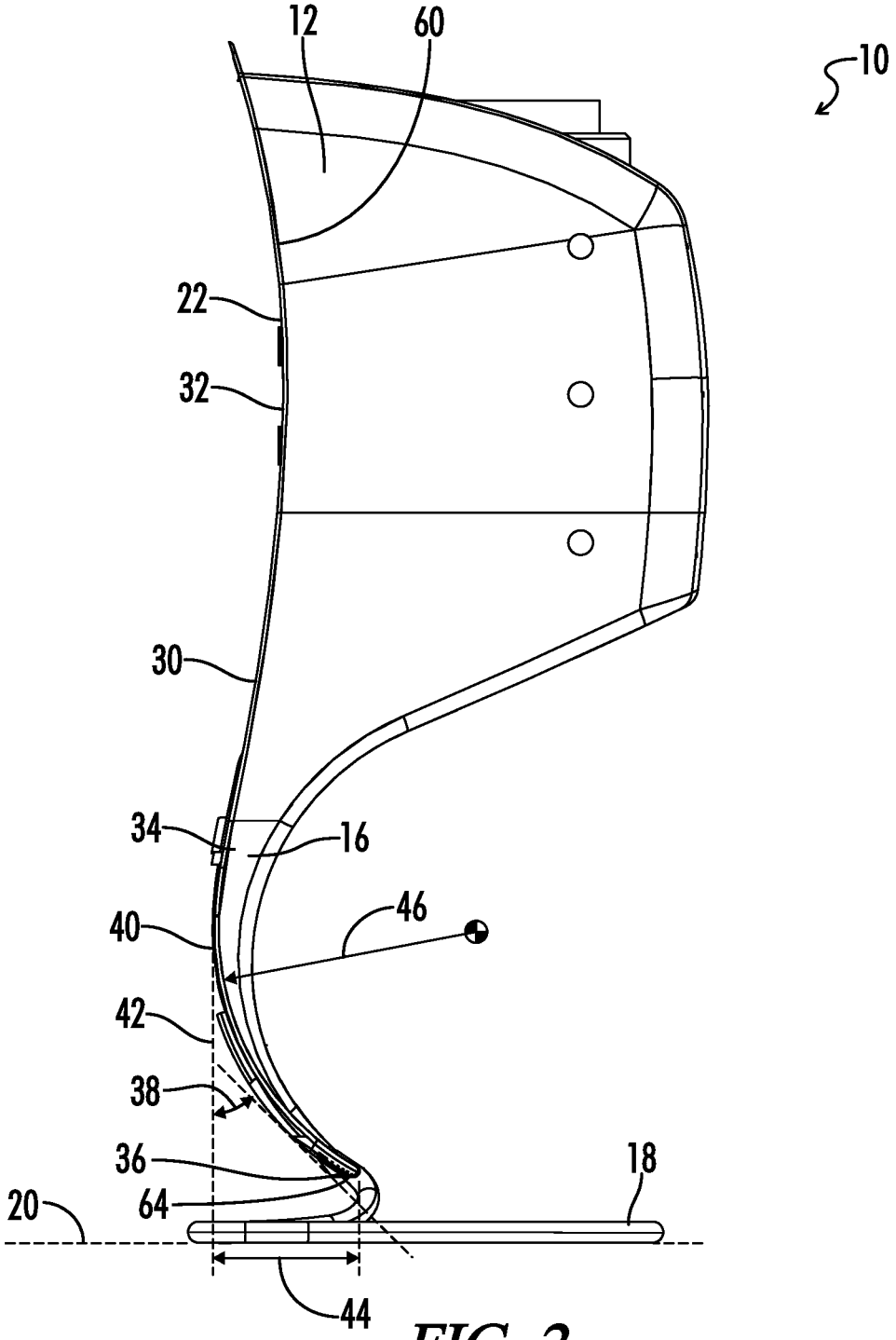
FIG. 2 is a side view of an embodiment of an integrally molded structure for a back pack sprayer apparatus of the present invention.

FIG. 2 shows a side view of an embodiment of the integrally molded structure 12 for the back pack sprayer 10. The front side 22 of the integrally molded structure 12 can include a compound curve 30 in side profile. The compound curve 30 can include an upper concave curve 32 configured to receive an operator's back when the back pack sprayer 10 is being used. The compound curve 30 can also include a lower convex curve 34. The lower convex curve 34 can terminate in a lowermost distal end 36. The lowermost distal end 36 can form a rearward angle 38 of at least 20 degrees relative to an axis 42 normal to the supporting plane 20. In some embodiments, rearward angle 38 is between about 20 and about 80 degrees. In some embodiments, rearward angle 38 is between about 30 and about 60 degrees. In some embodiments, rearward angle 38 is about 45 degrees.

In some embodiments, the lower convex curve 34 can have a forewardmost apex 40 when the back pack sprayer 10 is in an upright position. The radius of curvature 46 at the forwardmost apex 40 in some embodiments is no greater than about 6 inches. In some embodiments, the radius of curvature 46 of the lower convex curve 34 at the forwardmost apex 40 is between about 3 inches and about 6 inches. In some embodiments, the radius of curvature 46 of the lower convex curve 34 at the forwardmost apex is about 4.5 inches. Additionally in some embodiments, when the back pack sprayer 10 is in an upright position, the lowermost distal end 36 of the lower convex curve 34 extends rearward from the forwardmost apex 40 by an extension distance 44 of at least about 3 inches. In some embodiments, the extension distance 44 is between about 3 inches and about 5 inches. In some embodiments, the extension distance 44 is about 4 inches.

Referring again to FIG. 1, the tank portion 14 of the integrally molded structure 12 of the back pack sprayer 10 can include an upwardly open fill opening 48. In some embodiments, the fill opening 48 can have a central axis 51 having a generally vertical orientation. In some embodiments, the central axis 51 of the fill opening 48 can be angled relative to a vertical orientation. The tank portion 14 can be filled with chemicals or other liquids through fill opening 48. A cap 50 can be removably closed over the fill opening 48 to help prevent liquids from spilling or leaking out of the fill opening 48. The compound curve 30 of the front side 22 of the integrally molded structure 12 can extend from an uppermost edge 52. In some embodiments, the uppermost edge 52 of the compound curve 30 can be positioned higher than the fill opening 48 when the back pack sprayer 10 is in an upright position.

Additionally, in some embodiments, the tank portion 14 of the integrally molded structure 12 can include an upper surface 54. The upper surface 54 can include a central valley 56 defined in the upper surface 54, the central valley 56 having a valley floor 58. The fill opening 48 can be positioned in the central valley 56 such that the fill opening 48 extends upwardly from the valley floor 58. In some embodiments, at least a rear portion of the valley floor 58 slopes rearwardly such that any liquid spillage on the valley floor 58 is directed away from an operator. In some embodiments, the entire valley floor 58 slopes rearwardly away from an operator. A typical point of leakage for chemicals contained in a back pack sprayer 10 is at the fill opening 48. Having the fill opening 48 located in a central valley 56 having a valley floor 58 that at least partially slopes rearwardly away from an operator encourages any leakage coming from the fill opening 48 to be directed away from the operator and down the rear side 24 of the integrally molded structure 12.

Figure 3:
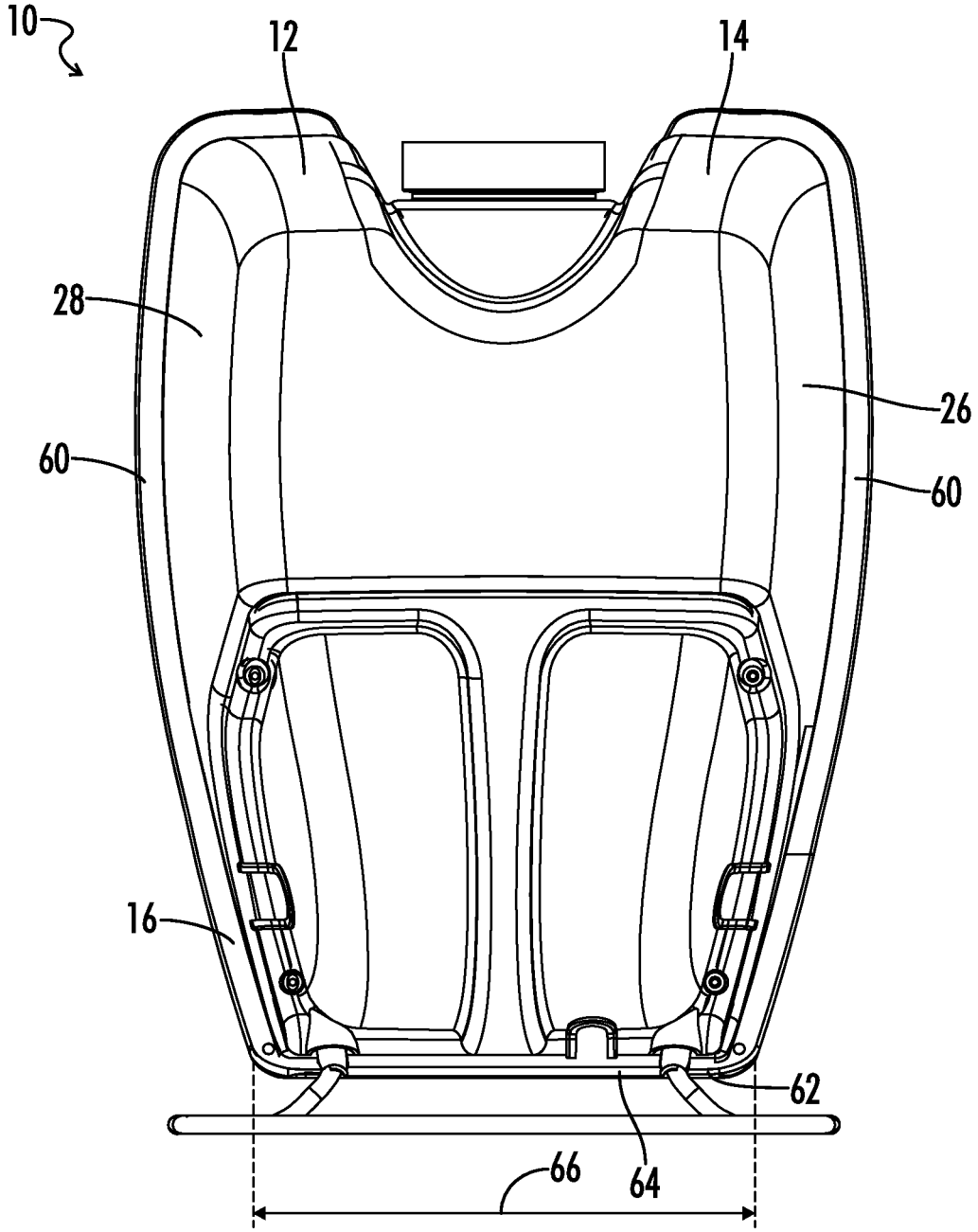
FIG. 3 is a rear view of the back pack sprayer apparatus of FIG. 1.

Another aspect of the present disclosure is shown in FIG. 3. The integrally molded structure 12 can further include rearward facing peripheral side flanges 60. The side flanges 60 can extend laterally outward along the left side 28 and the right side 26 of the integrally molded structure 12. From FIG. 2 it can be seen that the peripheral side flanges 60 can conform in side profile to the compound curve 30 of the front side 22. As such, the peripheral side flanges 60 form a barrier extending laterally generally proximate from the front side 22 of the integrally molded structure 12. The barrier can help prevent leaking liquids or chemicals running down the rear side 24 of the integrally molded structure 12 from contacting an operator's body.

Additionally, as shown in FIG. 3, the lower frame portion 16 of the integrally molded structure 12 can include a lower frame end 62. The lower frame end 62 can include a rearwardly curved rearward facing frame surface defining a lower drip rail 64. The lower drip rail 64 can extend across a width 66 of the lower frame portion 16. As shown in FIG. 1, the lower drip rail 64 can be generally coplanar with the peripheral side flanges 60. The lower drip rail 64 can also be configured to direct liquid spillage on the molded structure 12 away from an operator's body.

The lower drip rail 64 can conform generally to the lowermost distal end 36 of the lower frame portion 16. The rearward facing frame surface of the lower drip rail 64 in some embodiments can be substantially parallel to the lower convex curve 34 of the front side 22 of the integrally molded structure 12. As such, as seen in FIG. 2, the lower drip rail in some embodiments can extend rearwardly at the angle 38 to the vertical axis 42 of the apparatus 10 when the back pack sprayer 10 is in an upright position. In some embodiments, lower drip rail 64 can extend in a rearward direction from the forewardmost apex 40 by the extension distance 44.

The combination of the compound curve 30 of the front side 22, the peripheral side flanges 60, and the lower drip rail 64 can provide a significant safety feature for the back pack sprayer 10. The peripheral side flanges 60 and the lower drip rail 64 can generally help prevent any leakage from the tank portion 14 of the integrally molded structure from contacting an operator's body. Leakage running down the integrally molded structure 12 would make contact with the peripheral side flanges 60 or the lower drip rail 64 and would then run generally downward and rearward without contacting an operator's body.

Figure 4:
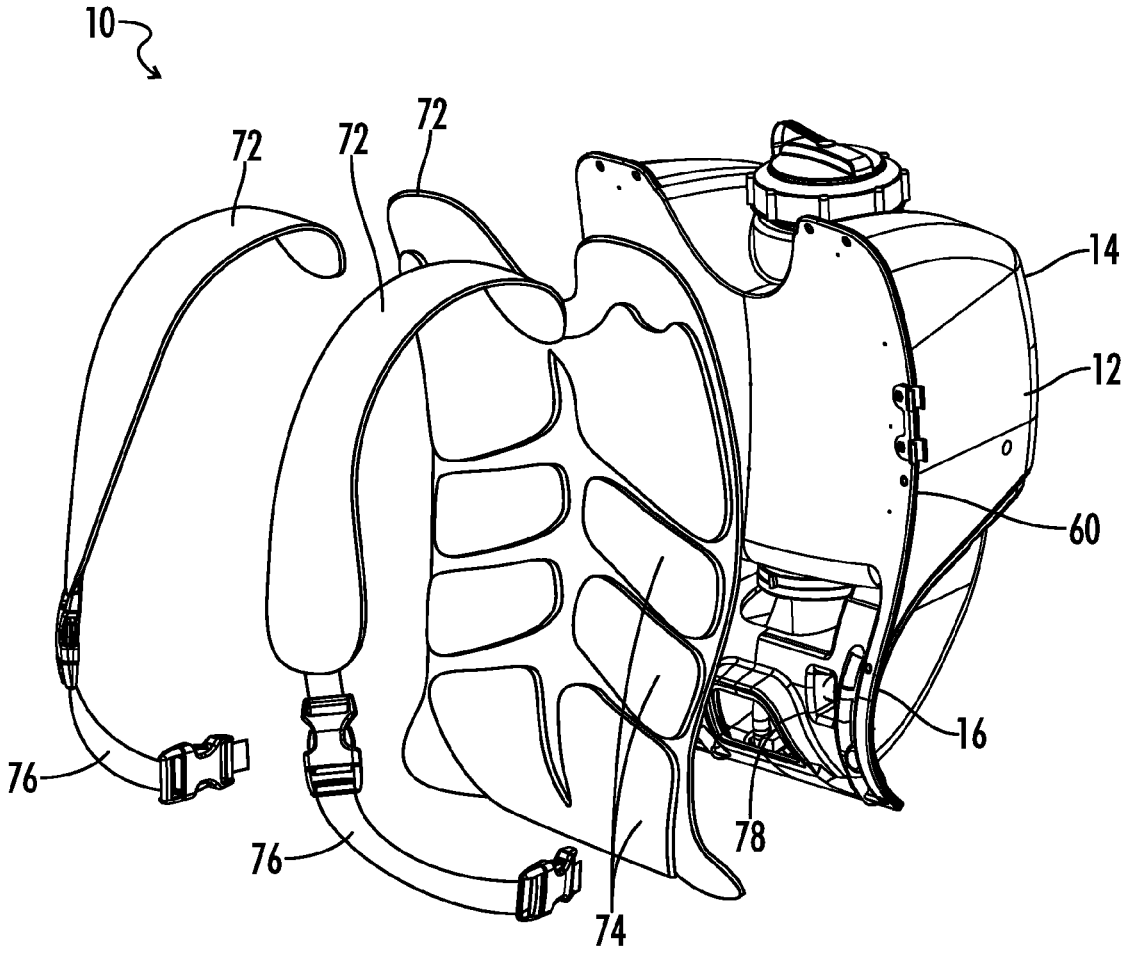
FIG. 4 is an exploded front perspective view of an embodiment of a back pack sprayer apparatus including a back strap assembly.

As shown in FIG. 4, the back pack sprayer 10 can include a back strap assembly 72 connected to the molded structure 12. The back strap assembly can be connected generally to the front side 22 of the integrally molded structure 12. In some embodiments, the back strap assembly 72 is connected to the upper tank portion 14. In some embodiments, the back strap assembly 72 is connected to the lower frame portion 16. In some embodiments, the back strap assembly 72 is connected to both the upper tank portion 14 and the lower frame portion 16. In some embodiments, the back strap assembly 72 can be connected to the peripheral side flanges 60.

The back strap assembly 72 can include one or more cushions 74. The cushions 74 can be positioned to rest against an operator's back or shoulders when the back pack sprayer 10 is in use. The cushions 74 can provide added comfort to an operator when the back pack sprayer 10 is in use. The cushions 74 can also provide ventilation between an operator's back and the back pack sprayer 10. The back strap assembly 72 can be operable to be worn on an operator's back or shoulders, thus making the back pack sprayer 10 easier to carry during use. The back strap assembly 72 can also provide an additional barrier layer between liquid spillage from the upper tank portion 14 and an operator, the liquid spillage contacting the back strap assembly 72 before the liquid spillage contacts the operator. The back strap assembly 72 can also include adjustable straps 76 which can allow the back strap assembly 72 to be adjusted to fit operators of different sizes.

Figure 5:
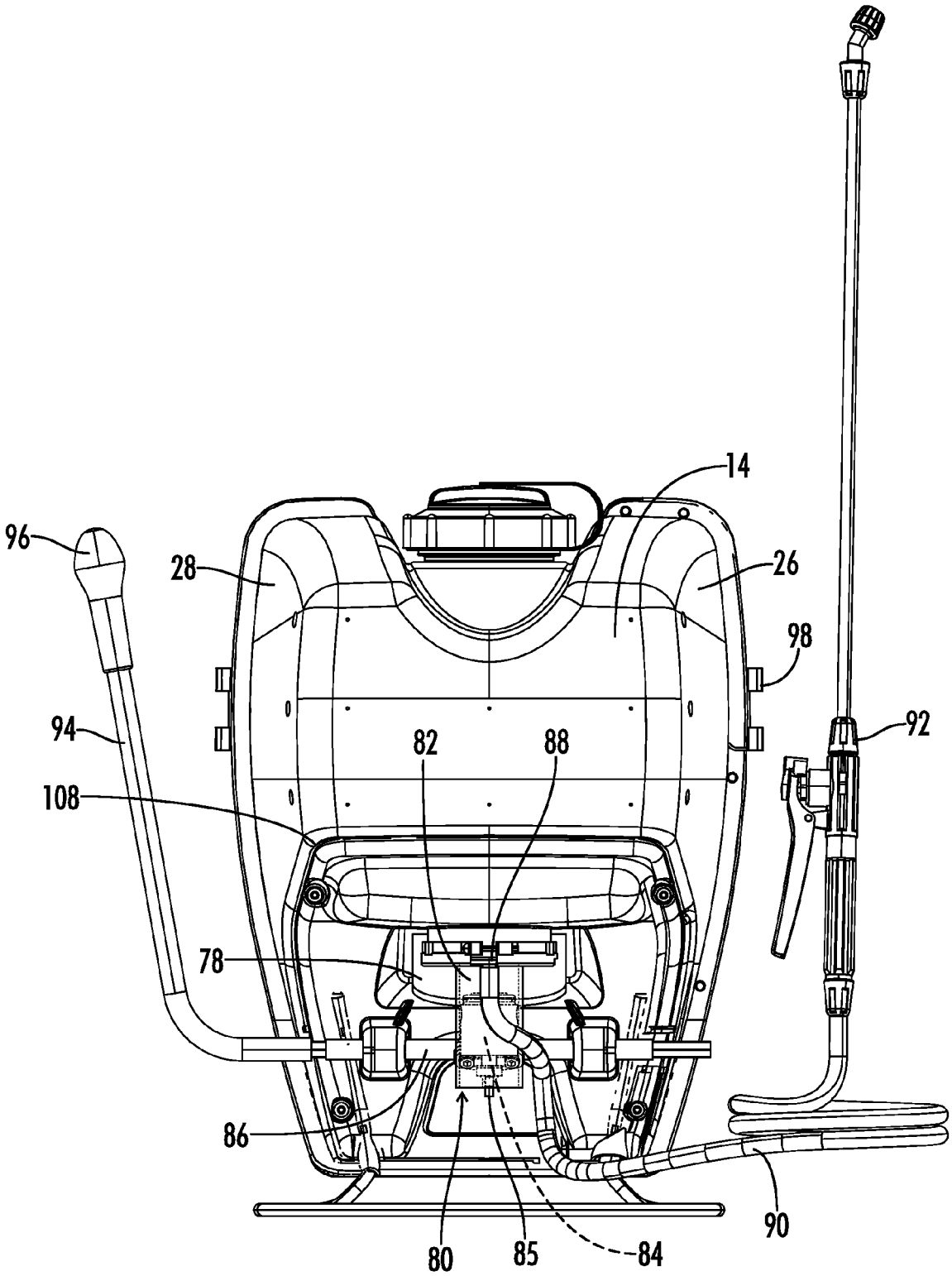
FIG. 5 is a rear view of an embodiment of a back pack sprayer apparatus without the removable cover attached to the back pack sprayer.

Another aspect of a back pack sprayer 10 of the present disclosure is shown in FIG. 5. In some embodiments, the lower frame portion 16 can have a frame opening 78 therethrough from the front side 22 to the rear side 24 of the integrally molded structure 12. A pump 80 can be communicated with the upper tank portion 14. The pump 80 can be located in the frame opening 78. The pump 80 being located in the frame opening 78 allows the pump 80 to be accessed from either the front side 22 or the rear side 24 of the integrally molded structure 12. Having two access points in the integrally molded structure 12 for the pump 80 makes it easier to access different parts of the pump 80 for maintenance, cleaning, or other purposes.

As shown in FIG. 4, the back strap assembly 72 can be positioned to cover the frame opening 78 in the lower frame portion 16. Having the back strap assembly 72 covering the frame opening 80 can help prevent leaking liquids from the upper tank portion 14 via the pump 80 from contacting an operator's body through the frame opening 78.

Figure 6:
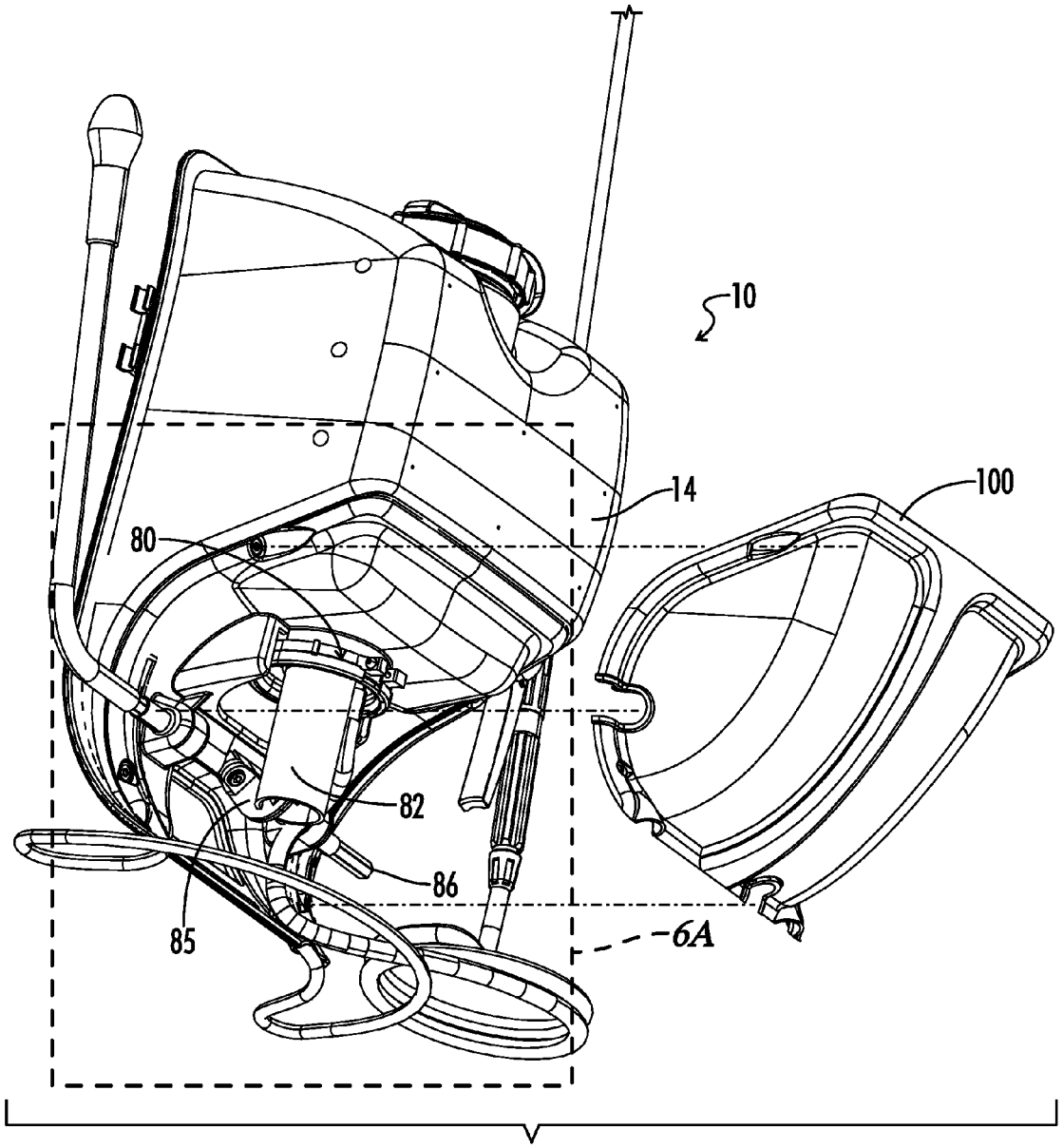
FIG. 6 is a perspective view of the back pack sprayer of FIG. 5 without the removable cover attached to the back pack sprayer.
Figure 6A:
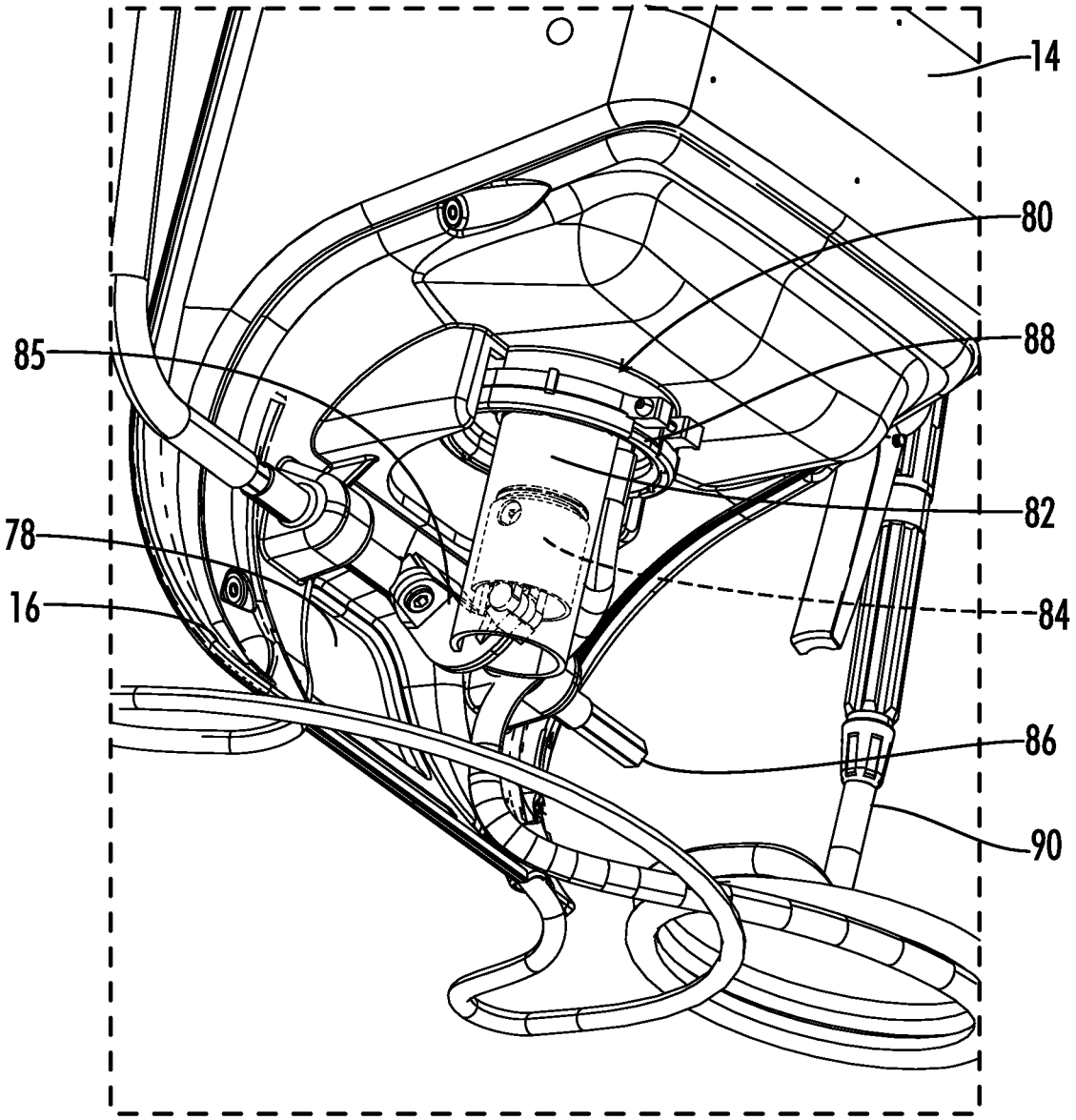
FIG. 6A is a close-up perspective view of the pump shown in FIG. 6.

A perspective view of the back pack sprayer 10 showing the pump 80 is shown in FIG. 6, and a close-up perspective view of the pump 80 is shown in FIG. 6A. The pump 80 can include a pressure cylinder 82 located within the upper tank portion 14. The pump 80 can further include a piston 84 located inside the pressure cylinder 82, and a knuckle 85 connected to the piston 84. The pump 80 can further include a shaft 86, the knuckle 85 connected to the shaft 86, the shaft 86 pivotally connected to the lower frame portion 16. The shaft 86 can be rotated to alternate the knuckle 85 and ultimately the piston 84 between a retracted position and an advanced position within the pressure cylinder 82. When the piston 84 is moved to the retracted position, liquid from the upper tank portion 14 is drawn into the pressure cylinder 82. When the piston 84 is moved into the advanced position, liquid in the pressure cylinder 82 is forced out of the pressure cylinder 82 through an outlet 88 in the pressure cylinder 82.

Referring again to FIG. 5, a hose 90 can be connected with the outlet 88 in the pressure cylinder 82. A sprayer 92 can be connected to the hose 90. As such, when the shaft 86 is reciprocated repeatedly and alternates the knuckle 85 and the piston 84 between a retracted and an advanced position, liquid from the upper tank portion 14 can be forced out of the pump 80 via the outlet 88 in the pressure cylinder 82 such that liquid pressure can build up in the hose 90. The sprayer 92 can be actuated to spray out the liquid from the hose 90, releasing the built up pressure. This process can then be repeated as needed to spread liquid or chemicals contained in the upper tank portion 14 on a targeted area. The back pack sprayer 10 can also include one or more sprayer clips 98 connected to the peripheral side flanges 60, the sprayer clips 98 configured to receive the sprayer 92 when the sprayer 92 is not in use.

A pump handle 94 can be connected to pump 80 via the shaft 86. The pump handle 94 can be connected to either end of the shaft 86, such that the pump handle 94 can be connected to the pump 80 in both a right handed orientation and a left handed orientation. The pump handle 94 is shown in a left handed orientation in FIG. 5. The sprayer 92 can then be held in an operator's right hand during use. The pump handle 94 could also be connected to the pump 80 in a right handed orientation, and the sprayer 92 could then be held in an operator's left hand during use. The pump handle 94 can also include a grip 96 configured to receive a user's hand in both the right handed orientation and the left handed orientation. In some embodiments the grip 86 can have a generally spherical or oblong spherical shape. In some embodiments, the grip can have a generally cylindrical shape. In still other embodiments, the grip 96 can include recesses that can receive an operator's fingers in both the left-handed and right-handed orientations.

Figure 7:
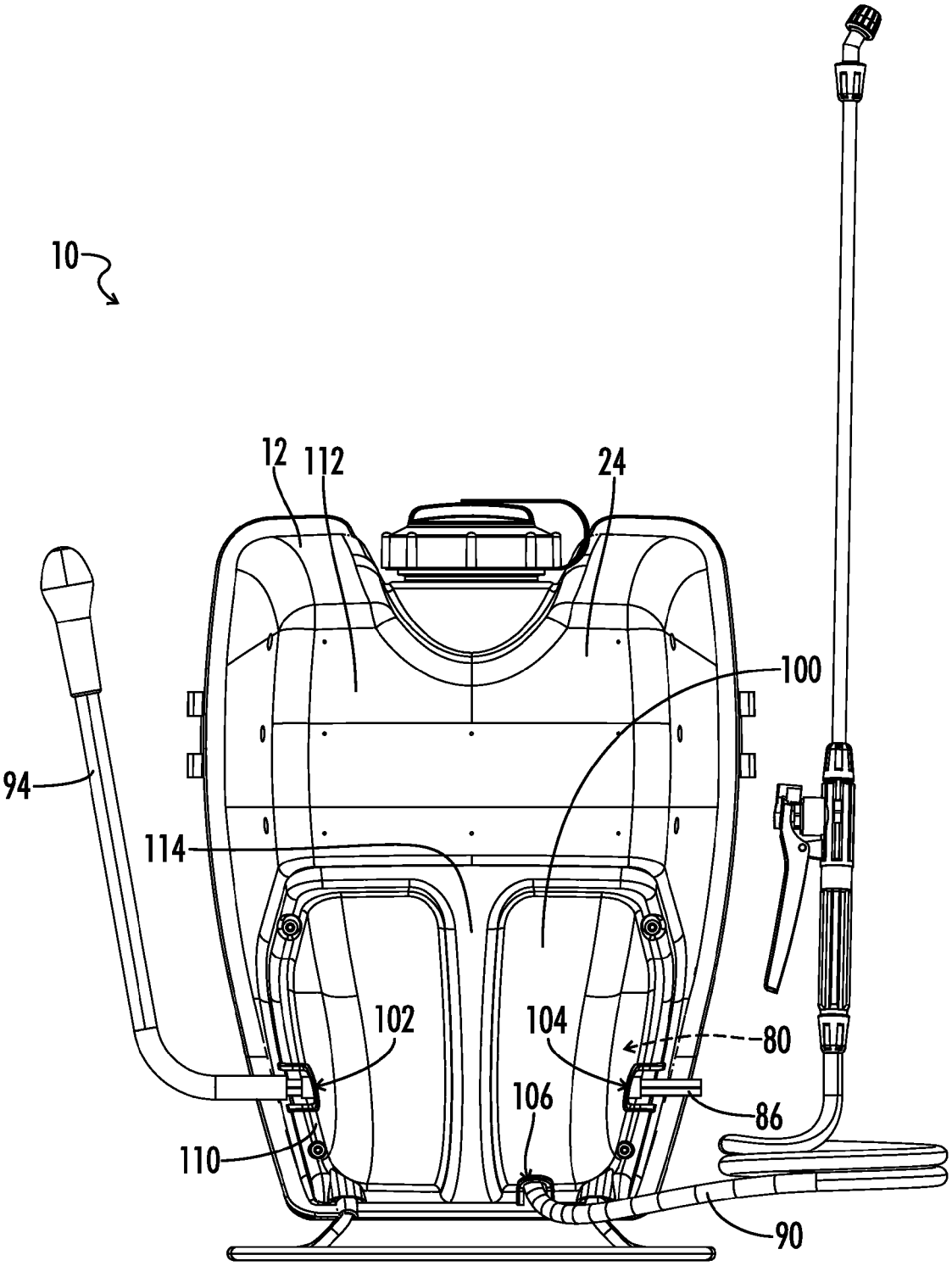
FIG. 7 is a rear view of the back pack sprayer apparatus of FIG. 5 with the removable cover attached to the back pack sprayer apparatus.

Another aspect of a back pack sprayer 10 of the present disclosure is shown in FIG. 7. The back pack sprayer 10 can include a removable rear cover 100 connected to the rear side 24 of the integrally molded structure 12. The cover 100 can be configured to close the frame opening 78 in the molded structure 12 and conceal the pump 80. The cover 100 can give the back pack sprayer 10 a more aesthetically appealing look as the mechanical contents of the pump 80 are covered. Additionally, the cover 100 can help keep the pump 80 clean and free of contaminants such as dirt which could impair the functionality of the back pack sprayer 10. The cover 100 can include a first opening 102 which allows the pump handle 94 access to a first end of shaft 86. The cover can include a second opening 104, which allows the pump handle 94 access to a second end of shaft 86. Additionally, the cover 100 can include a third opening 106 which the hose 90 can be passed through.

Figure 8:
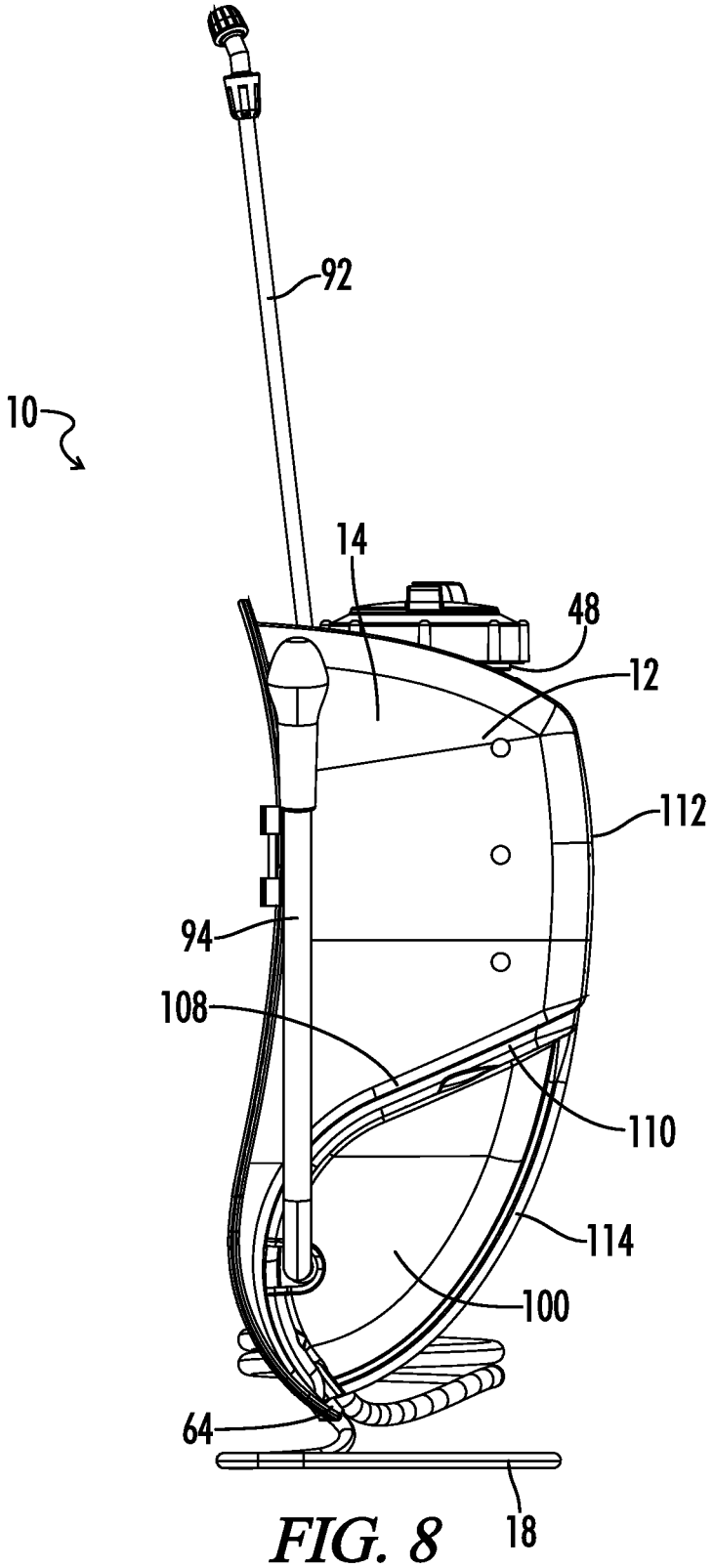
FIG. 8 is a side view of the back pack sprayer apparatus of FIG. 6 with the removable cover attached to the back pack sprayer apparatus.

In some embodiments, as shown in FIG. 8, the lower frame portion 16 of the molded structure 12 can have a rear surface 108 which is concave in side profile. The removable rear cover 100 can include a forward facing peripheral cover flange 110 which is convex in side profile. The peripheral cover flange 110 can be configured to be complementary to the concave rear surface 108 of the lower frame portion 16 such that the peripheral cover flange 110 fits against the concave rear surface 108. Peripheral cover flange 110 can then be removably connected to the rear concave surface 108 via conventional mechanical fasteners such as screws, bolts, etc. As such, the cover 100 can be quickly removed in order to inspect or repair the pump 80.

Additionally, in some embodiments, the upper tank portion 14 has a laterally central rearward facing tank rear surface 112. The tank rear surface 112 can be convex in side profile. The cover 100 can additionally have a rearward facing cover rear surface 114. The cover rear surface 114 can be convex in side profile and continue a line of the convex tank rear surface 112 when viewed in side profile. The convex rear surface 114 continuing the line of convex tank rear surface 112 allows liquid spillage from the fill opening 48 running down the tank rear surface 112 to continue along the cover rear surface 114. The cover rear surface 114 can abut the lower drip rail 64 such that liquid spillage running down the tank rear surface 112 and subsequently the cover rear surface 114 will contact the lower drip rail 64 and then be directed away from an operator's body as previously described above.

The integrally molded structure 12 can be manufactured from conventional blow molding processes in order to form the upper tank portion 14 with a fill opening 48. The support stand 18 can be integrally molded with the integrally molded structure 12 during the blow molding process, or the support stand 18 can be mechanically attached to the integrally molded structure 12 once the molded structure 12 has been manufactured. In some embodiments, the cap 50 for the fill opening 48 and the removable rear cover 100 can be manufactured using injection molding. In some embodiments, the different features of the back pack sprayer 10 can be manufactured using a plastic or other suitable material. The back strap assembly 72 can be made or sewn with nylon, polyethylene, or other suitable fabric.

Thus, although there have been described particular embodiments of the present invention of a new and useful Back Pack Sprayer, it is not intended that such references be construed as limitations upon the scope of this invention except as set forth in the following claims.

What is claimed is:

1. A backpack sprayer apparatus, comprising:

an integrally molded structure including an upper tank portion and a lower frame portion;

a support stand connected to the lower frame portion and defining a supporting plane of the apparatus for supporting the apparatus in an upright position from a ground surface when the apparatus is not being worn by an operator;

when the apparatus is in the upright position, the molded structure having a front side defining a compound curve in side profile, the compound curve including an upper concave curve configured to be received against the operator's back, and a lower convex curve terminating in a lowermost distal end of the molded structure and forming a rearward angle of at least 20 degrees relative to an axis normal to the supporting plane, the lower convex curve including a forwardmost apex, and the lowermost distal end of the molded structure extends rearward from the forwardmost apex by an extension distance of at least three inches;

wherein the lowermost distal end includes a rearwardly curved rearward facing surface defining a lower drip rail configured to direct liquid spillage on the molded structure away from the operator's body; and a removable rear cover cooperatively molded and attached to a rear side of the molded structure and closing a frame opening to conceal a pump.

2. The backpack sprayer apparatus of claim 1, wherein:

the rearward angle is at least 45 degrees relative to the axis.

3. The backpack sprayer apparatus of claim 1, wherein:

the radius of curvature of the lower convex curve at the apex is no greater than 6 inches.

4. The backpack sprayer apparatus of claim 1, wherein:

the rearward facing surface substantially parallels the lower convex curve of the front side of the molded structure.

5. The backpack sprayer apparatus of claim 1, wherein:

the tank portion includes an upwardly open fill opening; and the compound curve of the front side extends from an uppermost edge of the molded structure, the uppermost edge positioned higher than the fill opening.

6. The backpack sprayer apparatus of claim 5, wherein:

the tank portion includes an upper surface having a central valley defined in the upper surface, the valley having a valley floor, the fill opening extending upwardly from the valley floor.

7. The backpack sprayer apparatus of claim 6, wherein:

at least a rear portion of the valley floor slopes rearwardly such that liquid spillage on the valley floor is directed away from the operator's body.

8. The backpack sprayer apparatus of claim 1, wherein:

the molded structure includes a rearward facing peripheral flange extending laterally outward along left and right sides of the molded structure, the peripheral flange conforming in side profile to the compound curve of the front side such that liquid spillage on the molded structure is directed away from the operator's body.

9. The backpack sprayer apparatus of claim 1, further comprising:

the lower frame portion having the frame opening therethrough from the front side to the rear side of the molded structure;

a hose connected to the pump;

a sprayer connected to the hose; and a back strap assembly connected to the molded structure, the back strap assembly covering the frame opening and including one or more cushions positioned to rest against the operator's back.

10. The backpack sprayer apparatus of claim 1, further comprising:

the pump communicated with the tank portion and including a pump handle that can be connected to the pump in both a right-handed orientation and a left-handed orientation, the pump handle including a grip configured to receive the operator's hand in both the right-handed orientation and the left-handed orientation.

11. A backpack sprayer apparatus, comprising:

an integrally molded structure including an upper tank portion and a lower frame portion, the molded structure having a front side defining a compound curve in side profile, the compound curve including an upper concave curve configured to be received against an operator's back, and a lower convex curve terminating in a lowermost distal end of the molded structure, the lower frame portion having a frame opening therethrough from the front side to a rear side of the molded structure;

a pump located in the frame opening and communicated with the tank portion;

wherein the lowermost distal end includes a rearwardly curved rearward facing frame surface defining a lower drip rail configured to direct liquid spillage on the molded structure away from the operator's body; and a removable rear cover cooperatively molded and attached to the rear side of the molded structure and closing the frame opening to conceal the pump.

12. The backpack sprayer apparatus of claim 11, wherein:

the lower frame portion has a rear surface which is concave in side profile; and the removable rear cover has a forward facing peripheral cover flange convex in side profile and complementary to and fitted against the concave rear surface of the lower frame portion.

13. The backpack sprayer apparatus of claim 12, wherein:

the tank portion has a laterally central rearward facing tank rear surface convex in side profile; and the removable rear cover has a laterally central rearward facing cover rear surface convex in side profile and continuing a line of the convex tank rear surface when viewed in side profile.

14. The backpack sprayer apparatus of claim 11, wherein:

the rearward facing frame surface parallels the lower convex curve of the front side of the molded structure.

15. The backpack sprayer apparatus of claim 11, wherein:

the tank portion includes an upwardly open fill opening; and the compound curve of the front side extends from an uppermost edge of the molded structure, the uppermost edge positioned higher than the fill opening.

16. The backpack sprayer apparatus of claim 11, wherein:

the tank portion includes an upper surface having a central valley defined in the upper surface, the valley having a valley floor, the tank portion further including an upwardly open fill opening extending upwardly from the valley floor.

17. The backpack sprayer apparatus of claim 16, wherein:

at least a rear portion of the valley floor slopes rearwardly such that liquid spillage on the valley floor is directed away from the operator's body.

18. The backpack sprayer apparatus of claim 11, wherein:

the molded structure includes a rearward facing peripheral flange extending laterally outward along left and right sides of the molded structure, the peripheral flange conforming in side profile to the compound curve of the front side, so that liquid spillage on the molded structure is directed away from the operator's body.

19. The backpack sprayer apparatus of claim 11, further comprising:

a hose connected to the pump;

a sprayer connected to the hose; and a back strap assembly connected to the molded structure, the back strap assembly covering the frame opening and including one or more cushions positioned to rest against the operator's back.

20. The backpack sprayer apparatus of claim 11, further comprising:

a pump handle that can be connected to the pump in both a right-handed orientation and a left-handed orientation, the pump handle including a grip configured to receive the operator's hand in both the right-handed orientation and the left-handed orientation.

21. A backpack sprayer apparatus, comprising:

an integrally molded structure including an upper tank portion and a lower frame portion, the molded structure having a front side defining a compound curve in side profile, the compound curve including an upper concave curve and a lower convex curve;

the molded structure further including rearward facing peripheral side flanges extending laterally outward along a full length of left and right sides of the molded structure, the peripheral flanges conforming in side profile to the compound curve of the front side;

the lower frame portion of the integrally molded structure including a lower frame end having a rearwardly curved rearward facing surface defining a lower drip rail across a width of the lower frame portion, the lower drip rail being generally coplanar with the peripheral side flanges and configured to direct liquid spillage on the molded structure away from an operator's body;

the lower frame portion having a frame opening therethrough from the front side to a rear side of the molded structure;

a pump located in the frame opening and communicated with the tank portion; and a removable rear cover attached to the rear side of the molded structure and closing the frame opening to conceal the pump.

22. The backpack sprayer apparatus of claim 21, wherein:

the lower drip rail extends rearwardly at an angle of at least 20 degrees to a vertical axis of the apparatus when the apparatus is in an upright position.

23. The backpack sprayer apparatus of claim 22, wherein:

when the apparatus is in the upright position the lower convex curve of the front side has a forwardmost apex and the lower drip rail extends rearward from the forwardmost apex by an extension distance of at least 3 inches.

24. The backpack sprayer apparatus of claim 21, wherein:

the tank portion includes an upper surface having a central valley defined in the upper surface, the valley having a valley floor, the tank portion further including a fill opening extending upwardly from the valley floor, and at least a rear portion of the valley floor sloping rearwardly such that liquid spillage on the valley floor is directed away from the operator's body.

25. The backpack sprayer apparatus of claim 21, further comprising:

a hose connected to the pump;

a sprayer connected to the hose; and a back strap assembly connected to the molded structure, the back strap assembly covering the frame opening and including one or more cushions positioned to rest against the operator's back.

26. The backpack sprayer apparatus of claim 21, further comprising:

a pump handle that can be connected to the pump in both a right-handed orientation and a left-handed orientation, the pump handle including a grip configured to receive the operator's hand in both the right-handed orientation and the left-handed orientation.

* * * * *